US010955221B2

(12) United States Patent
Duncan, III

(10) Patent No.: US 10,955,221 B2
(45) Date of Patent: Mar. 23, 2021

(54) OPTIC MOUNT ASSEMBLY

(71) Applicant: Premier Shooting Solutions LLC, Madison, MS (US)

(72) Inventor: James L. Duncan, III, Madison, MS (US)

(73) Assignee: Premier Shooting Solutions LLC, Madison, MS (US)

( * ) Notice: Subject to any disclaimer, the term of this patent is extended or adjusted under 35 U.S.C. 154(b) by 0 days.

(21) Appl. No.: 16/434,457

(22) Filed: Jun. 7, 2019

(65) Prior Publication Data

US 2020/0386521 A1 Dec. 10, 2020

(51) Int. Cl.
*F41G 11/00* (2006.01)

(52) U.S. Cl.
CPC ..... *F41G 11/003* (2013.01)

(58) Field of Classification Search
CPC ..... F41G 11/003–005
USPC ..... 42/124, 127, 148
See application file for complete search history.

(56) References Cited

U.S. PATENT DOCUMENTS 1,856,549 A * 5/1932 Griffin ..... F41G 11/003 42/127
2,407,977 A * 9/1946 English ..... F41G 11/003 42/127
4,310,980 A * 1/1982 Pilkington ..... F41G 11/006 42/127
5,680,725 A * 10/1997 Bell ..... F41G 11/003 42/127
7,107,716 B1 * 9/2006 Liao ..... F41C 27/00 42/108
7,685,759 B2 * 3/2010 Teetzel ..... F41G 11/003 42/127
7,712,242 B2 * 5/2010 Matthews ..... F41G 11/003 248/229.11
7,823,316 B2 * 11/2010 Storch ..... F41G 11/003 42/127
8,336,246 B1 * 12/2012 Barber ..... F41G 11/003 42/124
8,438,965 B2 * 5/2013 Collin ..... F41G 11/003 89/125
8,707,606 B2 * 4/2014 Hoel ..... F41G 11/003 42/124
8,827,219 B2 * 9/2014 Kessler ..... F16M 11/048 248/187.1
8,959,825 B2 * 2/2015 Goertzen ..... F41G 11/003 42/124
9,568,281 B1 * 2/2017 Chen ..... F41A 23/10
10,036,614 B1 * 7/2018 Ruiz ..... F41C 27/00

* cited by examiner

*Primary Examiner* — Stephen Johnson
*Assistant Examiner* — Benjamin S Gomberg
(74) *Attorney, Agent, or Firm* — McCarter & English, LLP

(57) ABSTRACT

The application discloses an optic mount assembly for coupling an optic mount to a side rail of a firearm. The optic mount assembly includes a clamping bar including a body and protrusions extending from opposing side surfaces of the body. The optic mount assembly includes a lever pivotally coupled to the clamping bar. The optic mount assembly includes a fastener coupling the lever to the clamping bar. The clamping bar is configured to be at least partially inserted into and engaged with a cutout of the side rail, and configured to be inserted into a cutout in an optic mount.

19 Claims, 11 Drawing Sheets

OPTIC MOUNT ASSEMBLY

BACKGROUND

Various components or accessories can be attached to an existing rifle to improve the overall operation of the rifle and/or experience of the user. In some instances, a fixation point (e.g., a side rail, or the like) can be mounted to one side of the rifle and used as an interface to secure components or accessories to the rifle. For example, a side rail mounted to the side of a rifle can serve as a fixation point onto which an optic mount can be secured. Traditional side rails include a dovetail-shaped protrusion onto which the optic mount can be slidably attached, with the dovetail-shaped protrusion of the side rail and complementary dovetail-shaped groove in the optic mount engaged to prevent disassembly of the optic mount from the rifle. A set screw or other fastener can be used to maintain the position of the optic mount relative to the side rail. However, the fastener may loosen due to vibrations during use of the rifle and can result in inadvertent sliding of the optic mount along the side rail. In addition, due to the different types of optic mounts, the engagement protrusion and opening of the side rail and optic mount may not be optimally dimensioned, resulting in lateral and/or vertical movement or shifting of the optic mount relative to the side rail.

SUMMARY

The disclosure relates to an optic mount assembly for coupling an optic mount to a side rail of a rifle (e.g., an AK-47 rifle, or the like). The optic mount assembly includes a clamping bar and a lever pivotally coupled relative to each other by a fastener. The lever is configured with a posterior contour to be at least partially rotated into a corresponding contoured cutout of the side rail to prevent lateral movement of the optic mount relative to the side rail. Engagement of the lever relative to the clamping bar tightens the clamping bar against a surface of the side rail to prevent vertical movement of the optic mount relative to the side rail. Engagement of the clamping bar with the side rail can also prevent lateral movement of the optic mount relative to the side rail. The distance between the clamping bar and lever can be adjusted to customize the optic mount assembly for use with differently sized side rails.

In accordance with some embodiments of the present disclosure, an exemplary optic mount assembly is provided. The optic mount assembly includes a clamping bar including a body and protrusions extending from opposing side surfaces of the body. The optic mount assembly includes a lever pivotally coupled to the clamping bar. The optic mount assembly includes a fastener coupling the lever to the clamping bar.

The lever is configured to be at least partially rotated into and engaged with a cutout of a side rail, and configured to be inserted into a cutout in an optic mount. The clamping bar includes front and rear surfaces on opposing sides of the body. The protrusions extend from the opposing side surfaces and are aligned with the front surface of the clamping bar. The clamping bar includes a first recessed area formed in a bottom surface and extending a partial distance towards a top surface of the clamping bar, the first recessed area aligned with a front surface of the clamping bar. The clamping bar includes a second recessed area disposed within the first recessed area, the second recessed area including a plurality of radially spaced vertical slots configured to engage with a head of the fastener. The clamping bar includes a hole extending through the body, the first and second recessed areas concentrically disposed relative to the hole.

The lever includes a first section extending substantially perpendicularly from a second section. The first and second sections define a substantially L-shaped configuration. The second section includes a slot extending therethrough, the slot separating the second section into a top section and a bottom section. The lever includes a first hole extending through the top section and a second hole extending through the bottom section, the first and second holes aligned along a vertical axis. The fastener includes a head with a plurality of radially spaced peaks and valleys configured to engage with complementary slots formed in the clamping bar. The optic mount assembly includes one or more springs disposed between the clamping bar and the lever, or between the clamping bar and a body of an optic mount.

In accordance with exemplary embodiments of the present disclosure, an exemplary optic mount system is provided. The optic mount system includes an optic mount and an optic mount assembly coupled to the optic mount. The optic mount assembly includes a clamping bar including a body and protrusions extending from opposing side surfaces of the body. The optic mount assembly includes a lever pivotally coupled to the clamping bar. The optic mount assembly includes a fastener coupling the lever to the clamping bar.

The optic mount includes a cutout formed in a bottom surface and extending inwardly into a body of the optic mount. The cutout is configured complementary to the body and the protrusions of the clamping bar, the cutout configured to slidingly receive therein the clamping bar. The optic mount includes a central section with an outer step. The lever is configured to fit within the outer step of the optic mount. The optic mount includes a flange extending outwardly from a wall of the outer step. The lever includes a first section extending substantially perpendicularly from a second section, a slot extending through the second section and separating the second section into a top section and a bottom section. The flange of the optic mount is configured to fit within the slot of the second section of the lever.

In accordance with embodiments of the present disclosure, an exemplary optic mount assembly is provided. The optic mount assembly includes a clamping bar including a body with front and rear surfaces on opposing sides of the body. The clamping bar includes protrusions extending from opposing side surfaces of the body. The optic mount assembly includes a lever pivotally coupled to the clamping bar. The lever includes a first section extending substantially perpendicularly from a second section. The optic mount assembly includes a fastener coupling the lever to the clamping bar.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed optic mount assembly, reference is made to the accompanying figures, wherein.

DETAILED DESCRIPTION

The exemplary optic mount assembly for coupling an optic mount to a side rail of a rifle. The optic mount assembly includes a clamping bar and a lever pivotally coupled relative to each other by a fastener. The lever is configured to be at least partially rotated into a contoured cutout of a side rail to prevent lateral movement of the optic mount relative to the side rail. Engagement of the lever relative to the clamping bar tightens the clamping bar against a surface of the side rail to prevent vertical movement of the optic mount relative to the side rail. Engagement of the clamping bar with the side rail can also prevent lateral movement of the optic mount relative to the side rail. The distance between the clamping bar and lever can be adjusted to customize the optic mount assembly for use with differently sized side rails. The fastener includes radial peaks and valleys that allow incremental radial adjustment of the fastener relative to the clamping bar. Such adjustment of the fastener relative to the clamping bar adjusts the distance between the clamping bar and the lever for fixation of differently sized side rails.

Figure 1:
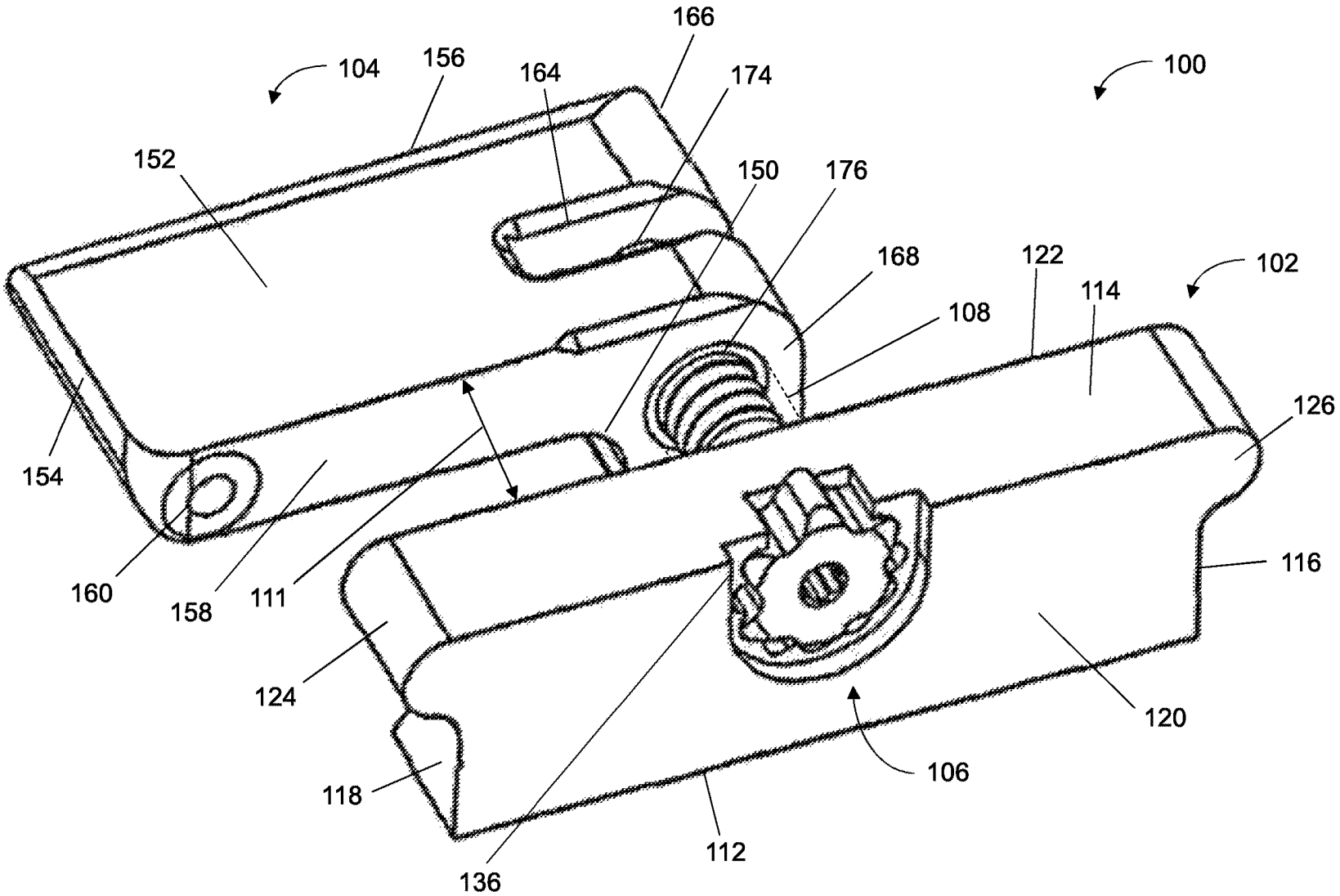
FIG. 1 is a perspective view of an exemplary optic mount assembly including a clamping bar, lever and fastener for mounting an optic mount to a fixation point in the form of a side rail.
Figure 2:
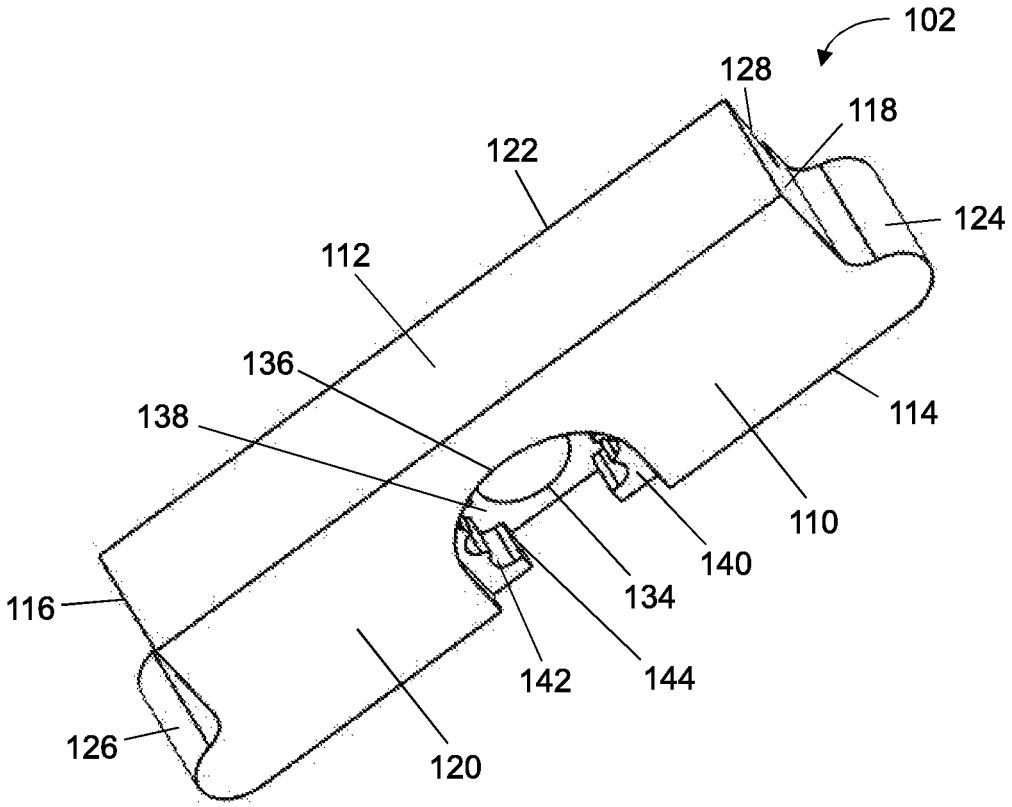
FIG. 2 is a perspective bottom view of an exemplary clamping bar of an optic mount assembly.
Figure 3:
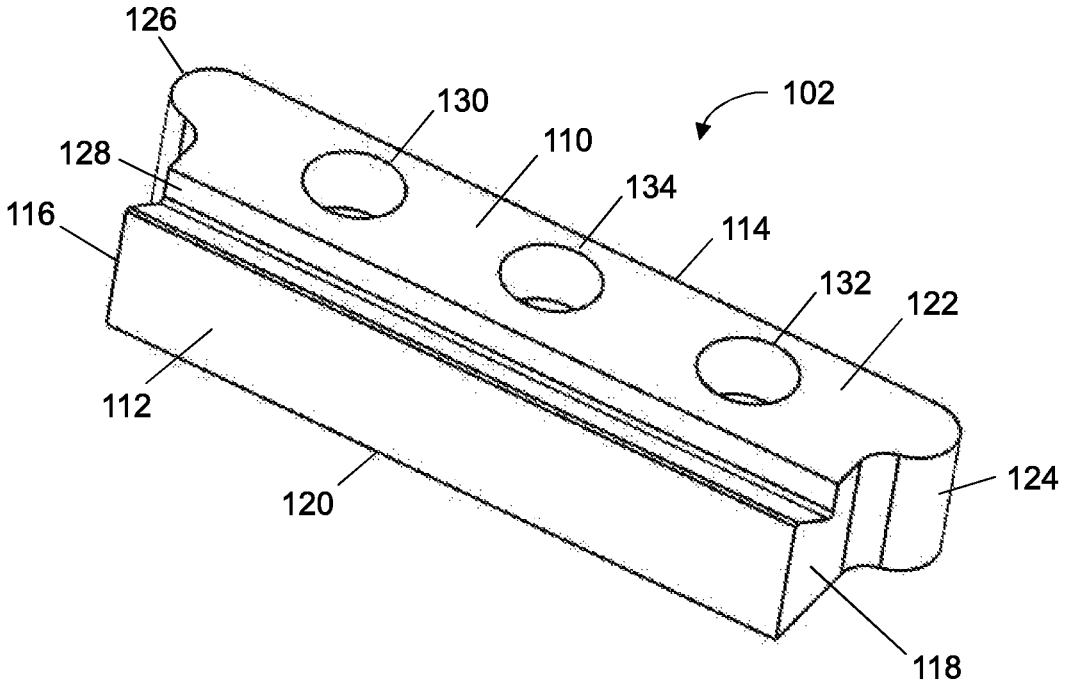
FIG. 3 is a perspective top view of an exemplary clamping bar of an optic mount assembly.
Figure 4:
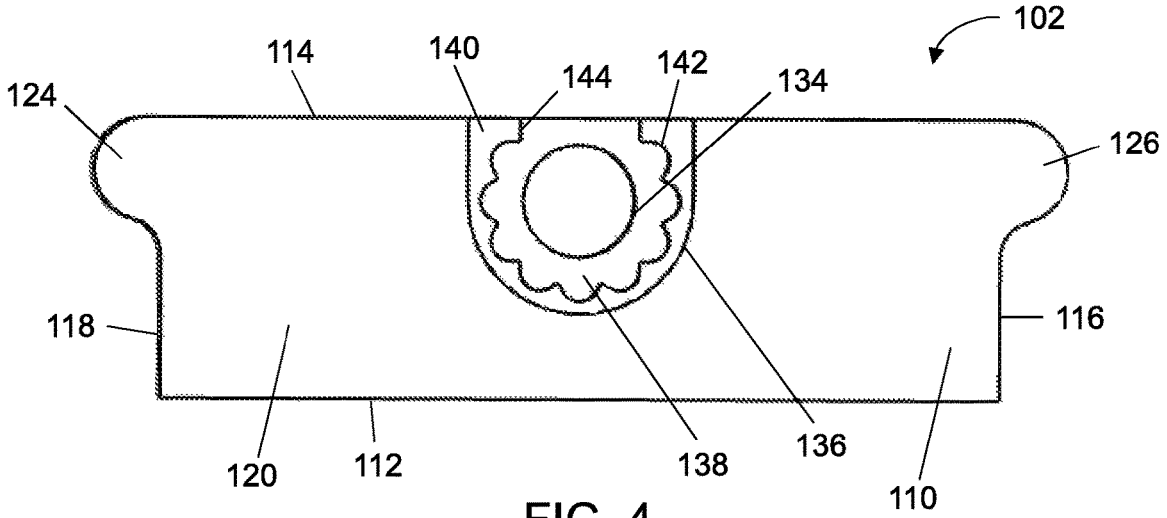
FIG. 4 is a bottom view of an exemplary clamping bar of an optic mount assembly.
Figure 5:
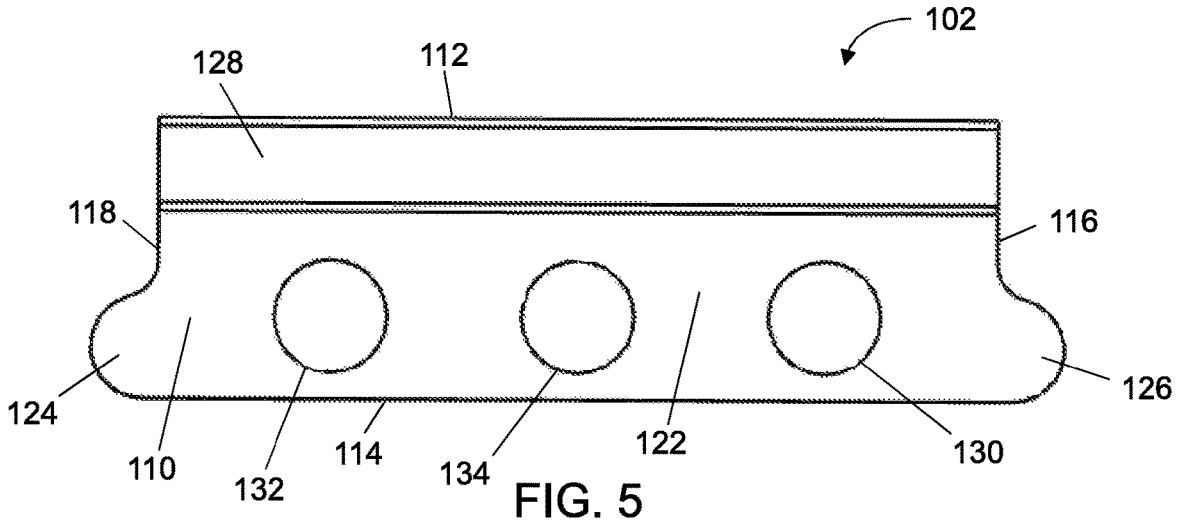
FIG. 5 is a top view of an exemplary clamping bar of an optic mount assembly.
Figure 6:
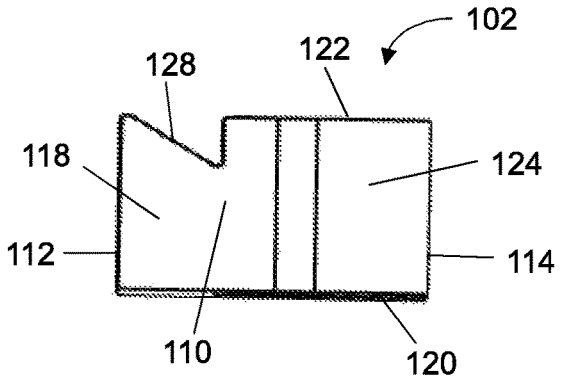
FIG. 6 is a side view of an exemplary clamping bar of an optic mount assembly.

FIG. 1 is a perspective view of an exemplary optic mount assembly 100. The optic mount assembly 100 can be used to detachably secure an optic mount to a fixation point (e.g., a side rail) of a fire arm, such as an AK rifle. The optic mount assembly 100 generally includes a clamping bar 102 and a lever 104 pivotally coupled relative to each other by a fastener 106. In some embodiments, a spring 108 (diagrammatically shown in FIG. 1) can be disposed around the fastener 106 and between the clamping bar 102 and lever 104 to provide a biasing force between the clamping bar 102 and lever 104, resulting in a quick-release function of the assembly 100. In some embodiments, springs 107, 109 (diagrammatically shown in FIG. 19) can be disposed within openings in the clamping bar 102 on either side of the fastener 106 (rather than around the fastener 106) to provide a biasing force between the clamping bar 102 and the body of the optic mount (e.g., optic mount 200 of FIGS. 11-16). Details of each of the components of the optic mount assembly 100 will be discussed below.

FIGS. 2-6 are perspective bottom, perspective top, bottom, top and side views of the exemplary clamping bar 102 of the optic mount assembly 100. With reference to FIGS. 1-6, the clamping bar 102 includes a body 110 defining a substantially rectangular configuration. The body 110 includes a substantially planar or flat rear surface 112, front surface 114, and side surfaces 116, 118. The rear and front surfaces 112, 114 can be substantially parallel to each other, and the side surfaces 116, 118 can be substantially parallel to each other. The body 110 includes bottom and top surfaces 120, 122 extending substantially parallel to each other.

At or near the front surface 114 of the clamping bar 102, the body 110 includes two semi-circular protrusions 124, 126 (e.g., wings) extending from opposing side surfaces 116, 118. The protrusions 124, 126 extend from the respective side surfaces 116, 118 and connect with the front surface 114 of the clamping bar 102, such that one end of the protrusions 124, 126 aligns with the plane defined by the front surface 114. The position of the protrusions 124, 126 results in a substantially T-shaped configuration of the body 110. The protrusions 124, 126 define a thickness dimensioned substantially similar to the thickness of the body 110, with the top and bottom surfaces of the protrusions 124, 126 aligned with planes defined by the respective bottom and top 120, 122 of the body 110.

The clamping bar 102 includes a cutout 128 formed in the top surface 122. The cutout 128 can be located at or near the rear surface 112, and extends downwardly or inwardly from the top surface 122 a partial distance towards the bottom surface 120. The cutout 128 can define a substantially V-shaped configuration. In some embodiments, one wall of the cutout 128 (e.g., the innermost wall) can extend substantially parallel to the rear and front surfaces 112, 114, and the second wall of the cutout 128 (e.g., the outermost wall) can extend at an angle relative to the rear and front surfaces 112, 114. The cutout 128 can extend between the side surfaces 116, 118, with the opening formed by the cutout 128 extending out through the side surfaces 116, 118. The cutout 128 can be configured complementary to one edge (e.g., a bottom edge) of a dovetail protrusion of a side rail. As will be discussed in greater detail below, the cutout 128 engages with the edge of the dovetail protrusion of the side rail to prevent vertical and/or lateral movement of the optic mount relative to the side rail.

The clamping bar 102 includes three holes 130-134 formed in the top surface 122 and extending towards the bottom surface 120. The holes 130-134 can be disposed between the cutout 128 and the front surface 114. Each of the holes 130-134 can be unthreaded. The holes 130, 132 can extend a partial distance through the thickness of the body 110 such that the holes 130, 132 are only visible at the top surface 122. In some embodiments, the holes 130, 132 can extend half of the thickness of the body 110. In some embodiments, the holes 130, 132 can receive one end of one or more springs (e.g., springs 107, 109 of FIG. 19) to provide a biasing force against the clamping bar 102, with the opposing end of the springs disposed within corresponding holes in the optic mount. A biasing force is thereby provided between the clamping bar 102 and the optic mount by the springs 107, 109. The central hole 134 extends through the body 110 such that the hole 134 is visible at both the top and bottom surfaces 122, 120.

The clamping bar 102 includes a substantially semi-circular groove or recessed area 136 (e.g., first recessed area) formed in the bottom surface 120 and extending downwardly towards the top surface 122. The recessed area 136 extends a partial distance or thickness towards the top surface 122 (e.g., about ⅛ of the thickness, about ¼ of the thickness, or the like). The recessed area 136 is disposed such that the curved section faces the rear surface 112 and the flat or planar section is aligned with the front surface 114, forming an opening at the front surface 114. The recessed area 136 is substantially concentrically disposed relative to the hole 134.

The first recessed area 136 includes a second recessed area 138 disposed within the first recessed area 136 and extending a partial distance or thickness towards the top surface 122 from the recessed area 136. The recessed area 138 forms a circumferential step 140 substantially circumferentially disposed relative to the hole 134. The height of the circumferential step 140 can correspond with the thickness of the fastener 106 head, such that the fastener 106 head can be inserted into the recessed area 138. The clamping bar 102 includes a plurality of radially spaced slots 142 formed in the circumferential step 140. The slots 142 are radially spaced around the hole 134 and are formed in the inner walls of the circumferential step 140, thereby extending upwards and above the hole 134. As will be discussed in greater detail below, the slots 142 engage with complementary edges or protrusions of the fastener 106 to provide multiple engagement positions between the fastener 106 and the clamping bar 102. A gap 144 between walls of the circumferential step 140 forms an opening at the front surface 114. The width of the gap 144 can be dimensioned smaller than the width of the opening formed by the first recessed area 136.

Figure 7:
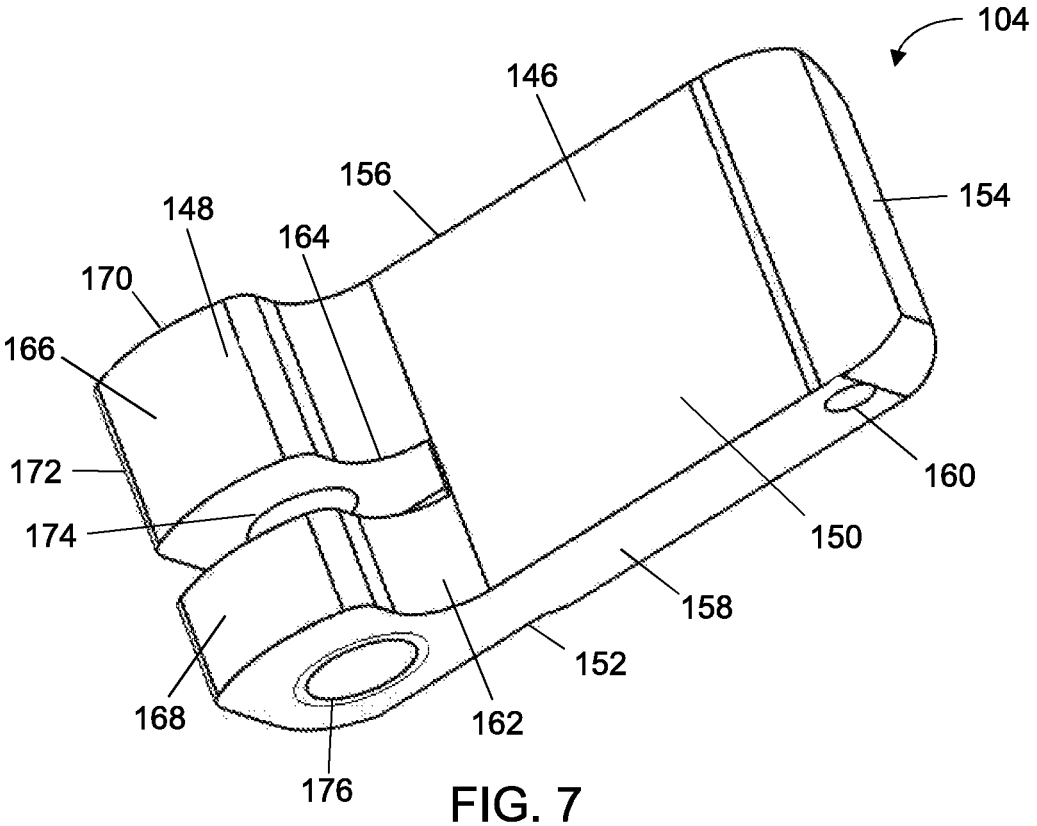
FIG. 7 is a perspective bottom view of an exemplary lever of an optic mount assembly.
Figure 8:
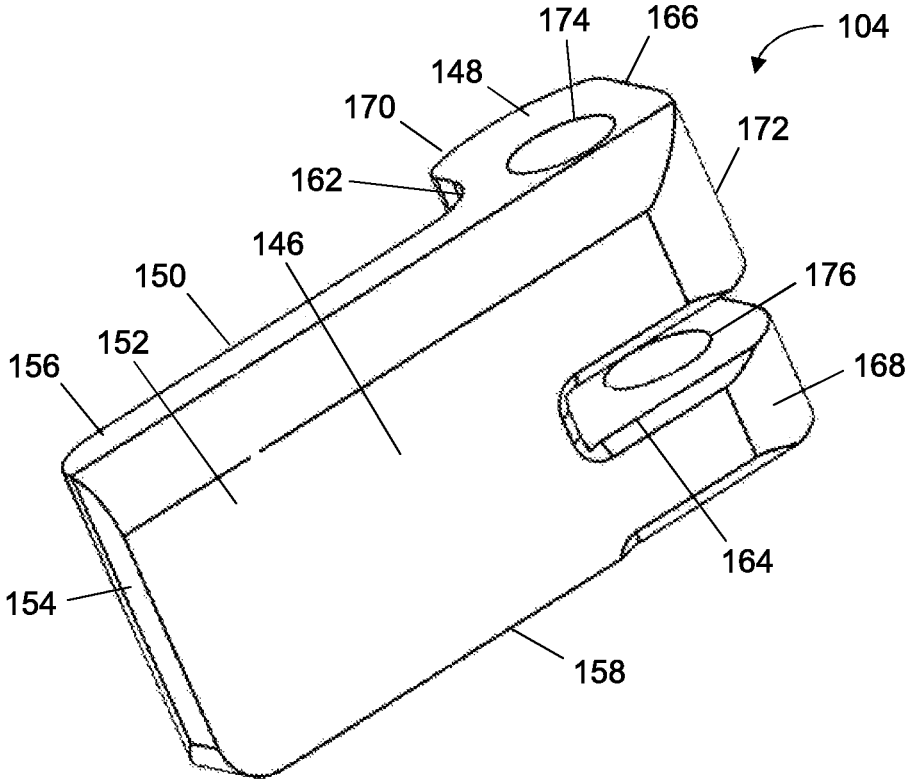
FIG. 8 is a perspective top view of an exemplary lever of an optic mount assembly.
Figure 9:
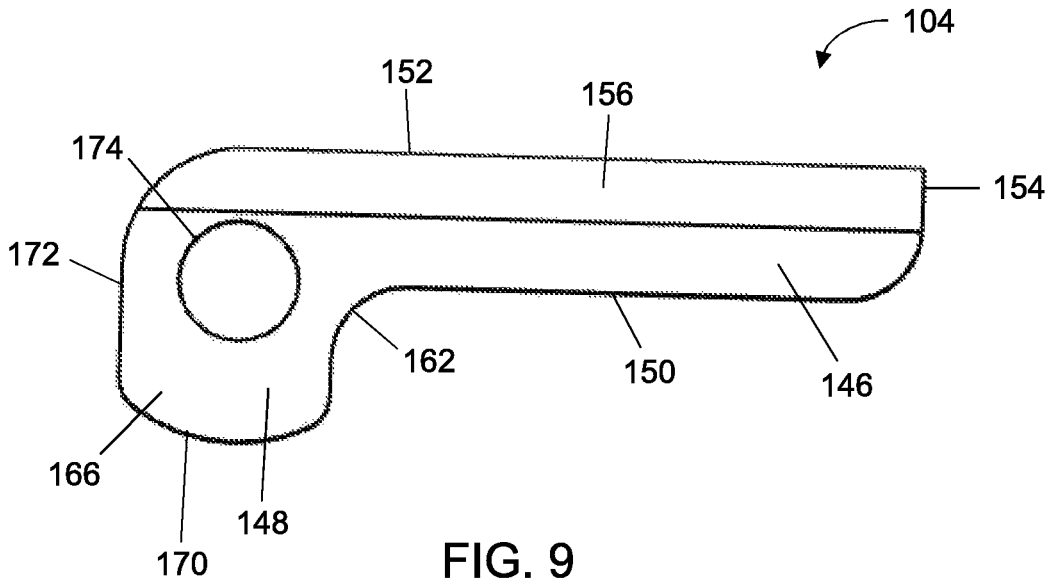
FIG. 9 is a top view of an exemplary lever of an optic mount assembly.

FIGS. 7-9 are perspective bottom, perspective top and top views of the exemplary lever 104 of the optic mount assembly 100. With reference to FIGS. 1 and 7-9, the lever 104 includes a body with a first section 146 and a second section 148 extending substantially perpendicularly from each other. The first section 146 defines a substantially rectangular configuration, including an inner surface 150, and outer surface 152, an end surface 154, and top and bottom surfaces 156, 158. In some embodiments, the first section 146 can taper slightly towards the end surface 154, thereby reducing the thickness of the first section 146 at or near the end surface 154. The first section 146 includes a detent 160 formed in the bottom surface 158 and extending a partial distance upwards towards the top surface 156. As will be discussed below, the detent 160 is configured to receive a spring-loaded ball of an engagement mechanism of an optic mount to maintain the position of the lever 104 relative to the optic mount.

The first section 146 can connect to the second section 148 at a substantially curved area 162 disposed at the inner surface 150. The second section 148 includes a slot 164 extending therethrough. The slot 164 can extend substantially parallel to the top and bottom surfaces 156, 158, extending the full thickness of the second section 148. The slot 164 separates the second section 148 into a top section 166 and a bottom section 168. The slot 164 can extend through the curved area 162 without extending through the first section 146. In some embodiments, the slot 164 can be disposed substantially centrally between the top and bottom surfaces 156, 158. In such embodiments, the length or height of the top and bottom sections 166, 168 can be substantially equal. In some embodiments, the slot 164 can be disposed closer to the bottom surface 158 (see, e.g., FIG. 7). In such embodiments, the length or height of the top section 166 can be dimensioned greater than the length or height of the bottom section 168. The top and/or bottom sections 166, 168 can be contoured to engage with a reverse contoured cutout in the side rail (see, e.g., scalloped section 302 in fixation point 300 of FIG. 20) to prevent lateral movement of the optic mount relative to the side rail. In some embodiments, only the bottom section 168 can engage with the scalloped section 302 in the fixation point 300. The smaller height of the bottom section 168 provides sufficient room during assembly with an optic mount to permit sliding of the clamping bar 102 within the optic mount to accommodate side rails of different dimensions.

The configuration of each of the top and bottom sections 166, 168 can be substantially equal (except for the dimensional difference noted above). The inner face 170 of the top and bottom sections 166, 168 can be substantially rounded (e.g., convex), while the side face 172 of the top and bottom sections 166, 168 can be substantially flat. The side face 172 can define the opposing end of the lever 104 relative to the end surface 154. Each of the top and bottom sections 166, 168 includes a hole 174, 176 extending therethrough along an axis perpendicular to the top and bottom surfaces 156, 158. The holes 174, 176 can extend along the same vertical axis. Each of the holes 174, 176 can include internal threads complementary to the outer threads of the fastener 106. The diameter of the holes 174, 176 can be dimensioned such that the fastener 106 can be inserted therethrough by engaging the complementary threads.

Figure 10:
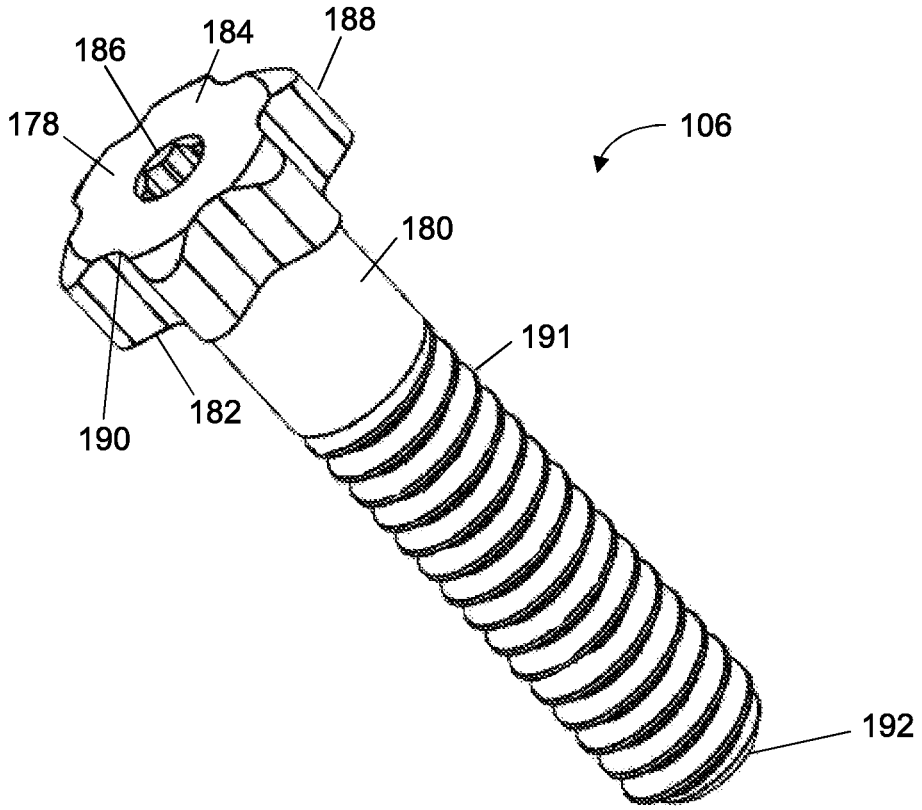
FIG. 10 is a perspective view of an exemplary fastener of an optic mount assembly.
Figure 11:
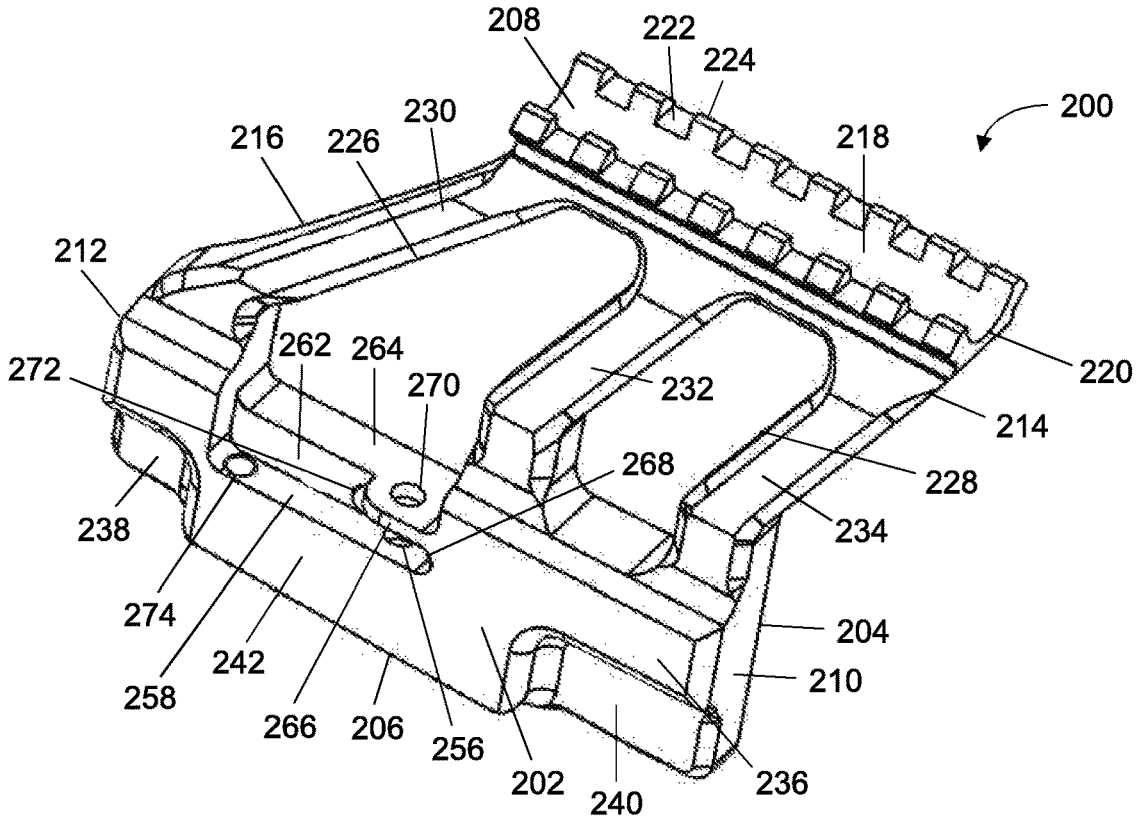
FIG. 11 is a perspective front view of an exemplary optic mount.
Figure 12:
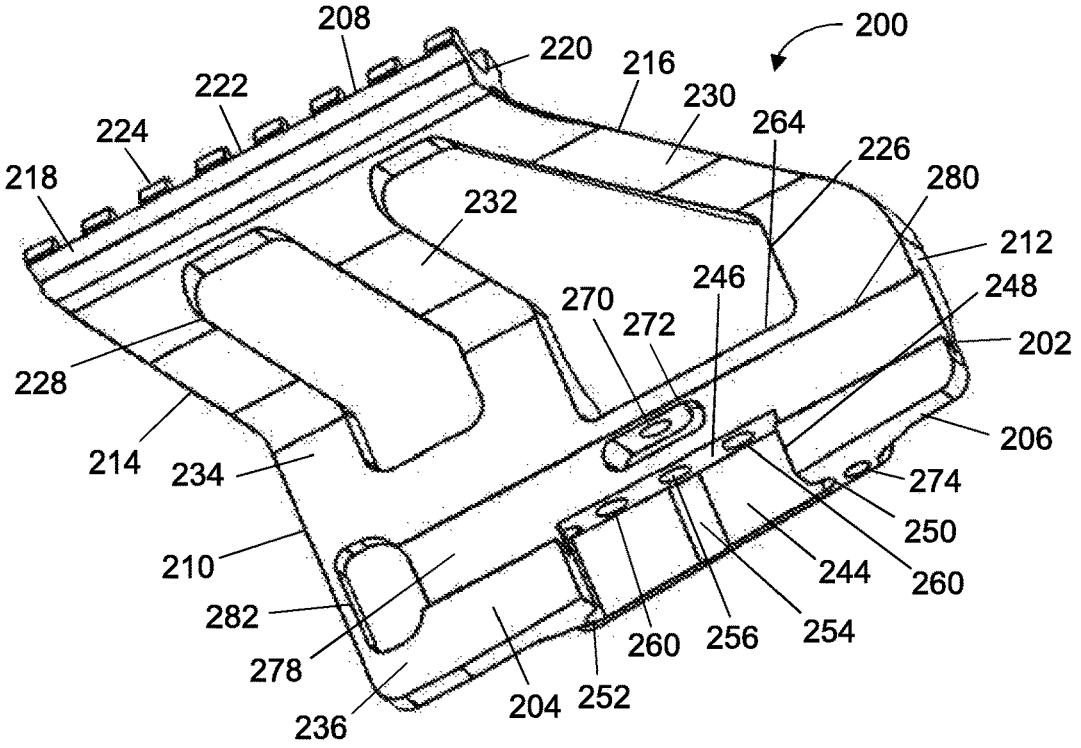
FIG. 12 is a perspective rear view of an exemplary optic mount.
Figure 13:
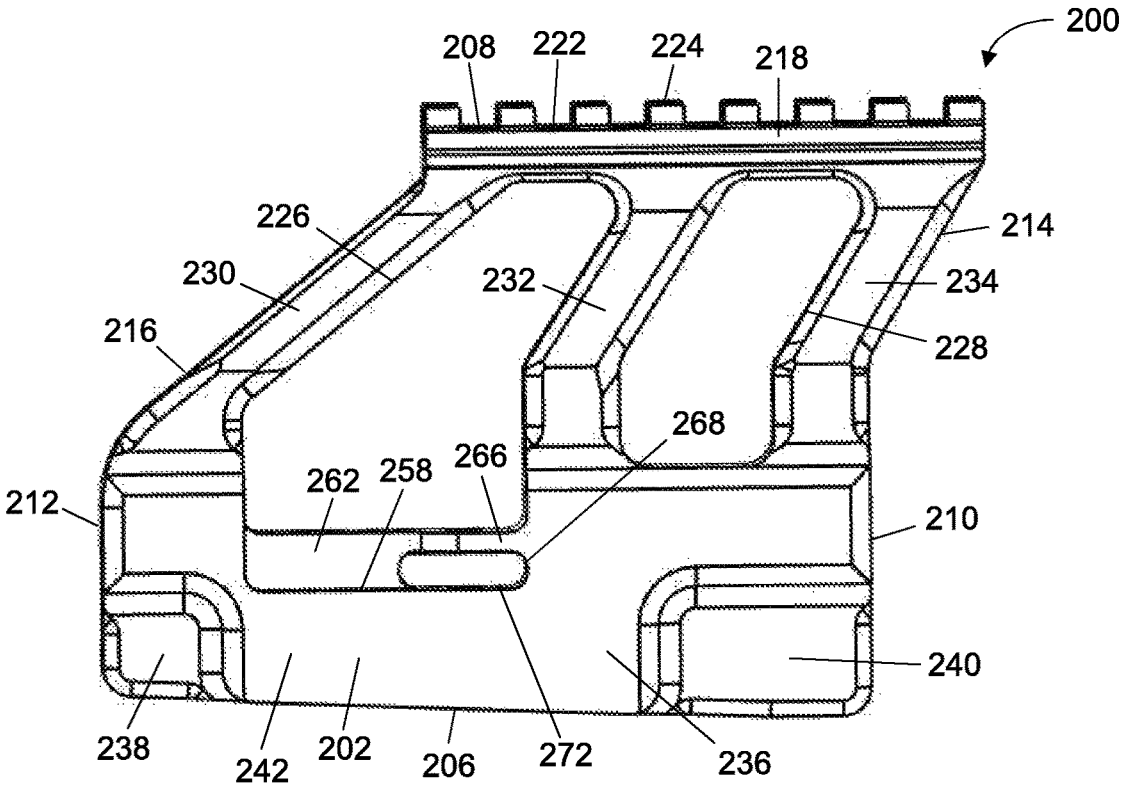
FIG. 13 is a front view of an exemplary optic mount.
Figure 14:
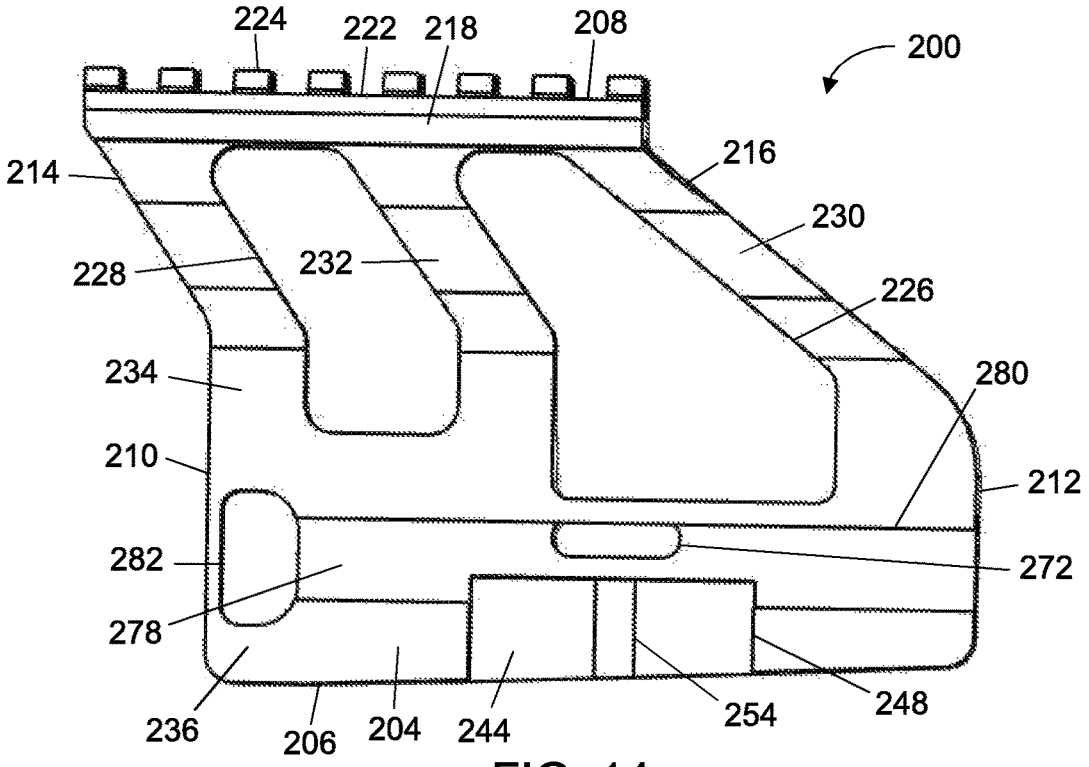
FIG. 14 is a rear view of an exemplary optic mount.

FIG. 10 is a perspective view of the exemplary fastener 106 of the optic mount assembly 100. The fastener 106 includes a head 178 and a substantially cylindrical body 180 extending perpendicularly from a bottom surface 182 of the head 178. A top surface 184 of the head 178 can define a substantially planar or flat configuration. The head 178 includes a hexagonal opening 186 formed in the top surface 184 and extending towards the bottom surface 182 a partial distance or thickness of the head 178. The opening 186 can extend along the same central longitudinal axis as the cylindrical body 180. The hexagonal opening 186 can be configured to receive a hex key.

The circumferential side edge of the head 178 includes a plurality of radially spaced protrusions or peaks 188 separated by a plurality of radially spaced valleys 190. The configuration of the peaks 188 and valleys 190 can be complementary to the radially spaced slots 142 formed in the clamping bar 102, such that the cylindrical body 180 can be passed through the hole 134 and the head 178 can slide within the slots 142 to engage with the clamping bar 102. In some embodiments, the head 178 can include six peaks 188. As will be discussed in greater detail below, the multiple peaks 188 in the head 178 allow for the engagement position between the fastener 106 and the clamping bar 102 to be incrementally adjusted prior to assembly with a side rail, ensuring that the optic mount assembly 100 can be customized and adjusted for side rails of different thicknesses. The cylindrical body 180 includes external threads 191 along at least a portion of the body 180, with the threads 191 extending downwardly along the body 180 up to a distal end 192 of the fastener 106. The distal end 192 can be the opposing end from the head 178.

With reference to FIGS. 1-10, during assembly, the body 180 of the fastener 106 can be passed through the hole 134 of the clamping bar 102 until the protrusions 188 of the head 178 engage with the slots 142 in the clamping bar 102. In one embodiment, the spring 108 can be disposed over the body 180 of the fastener 106, and the distal end 192 of the fastener 106 can be threaded into the hole 176 of the lever 104. In such embodiment, a biasing force is created between the clamping bar 102 and the lever 104 by the spring 108. In another embodiment, springs 107, 109 (shown in FIG. 19) can be disposed within the holes 130, 134 of the clamping bar 102 on either side of the fastener 106 to provide a substantially equal bilateral biasing force between the clamping bar 102 and the optic mount. One end of the springs 107, 109 can be disposed within the holes 130, 134, and the opposing end of the springs 107, 109 can be disposed within corresponding holes (e.g., holes 260 in FIG. 12) in the optic mount to maintain the position and alignment of the springs 107, 109. Thus, either one central spring 108 can be used, two springs 107, 109 on opposing sides of the fastener 106 can be used, or all three springs 107, 108, 109 can be used. Engagement of the protrusions 188 of the head 178 of the fastener 106 with the slots 142 of the clamping bar 102 ensure that the radial position of the fastener 106 relative to the clamping bar 102 is maintained during rotation or pivoting of the lever 104.

Rotation or pivoting of the lever 104 relative to the clamping bar 102 in one direction at least partially unthreads the fastener 106 from the hole 176, increasing the distance 111 between the lever 104 and the clamping bar 102 (see, e.g., FIG. 1). Rotation or pivoting of the lever 104 relative to the clamping bar 102 in the opposing direction threads the fastener 106 further into the hole 176 of the lever 104 reducing the distance 111 between the lever 104 and the clamping bar 102. Such rotation can be used to tighten or loosen the optic mount assembly 100 relative to an optic mount and/or side rail. In embodiments having the spring 108 disposed around the fastener 106, the spring 108 biases the clamping bar 102 from the lever 104. In embodiments having the springs 107, 109, the springs 107, 109 biase the clamping bar 102 from the optic mount body. Therefore, when the lever 104 is rotated relative to the clamping bar 102 to increase the distance 111 between the lever 104 and clamping bar 102, the spring 108 (or springs 107, 109) can bias the clamping bar 102 away from the lever 104 (or the optic mount body) to act as a quick-release feature.

Due to the difference in widths of the dovetail-shaped protrusion of the side rail, the initial distance 111 between the lever 104 and the clamping bar 102 may need to be adjusted prior to tightening the assembly 100 relative to the optic mount and/or side rail. The configuration of the head 178 of the fastener 106 provides for up to twelve different radial positions of the fastener 106 relative to the clamping bar 102. For example, if the distance 111 between the lever 104 and clamping bar 102 is too small, the head 178 can be disengaged from the clamping bar 102, the fastener 106 can be rotated slightly clockwise or counterclockwise to reposition the peaks 188 relative to the slots 142 of the clamping bar 102. Once reengaged, the distance 111 between the lever 104 and clamping bar 102 can be checked and adjusted as needed to ensure a tight connection between the assembly 100 and the optic mount and/or side rail when the lever 104 is positioned in the locked position. The configuration of the fastener 106 thereby provides for incremental adjustment of the assembly 100, allowing customization of the assembly 100 for different side rails.

FIGS. 11-16 are perspective front, perspective rear, front, rear, bottom and side views of an exemplary optic mount 200. The optic mount assembly 100 can be incorporated into the optic mount 200 for securing the optic mount 200 to a side rail of a rifle. The optic mount 200 includes a body having a front surface 202, a rear surface 204, a bottom surface 206, and a top surface 208. The optic mount 200 includes first opposing side sections 210, 212 extending from the bottom surface 206 in a substantially parallel manner relative to each other and a substantially perpendicular manner relative to the bottom surface 206. The optic mount 200 includes second opposing side sections 214, 216 extending from the first opposing side sections 210, 212 and connecting with the top surface 208. The second opposing side sections 214, 216 extend at an angle relative to the first opposing side sections 210, 212, the bottom surface 206 and the top surface 208 (e.g., angled rearward).

Figure 16:
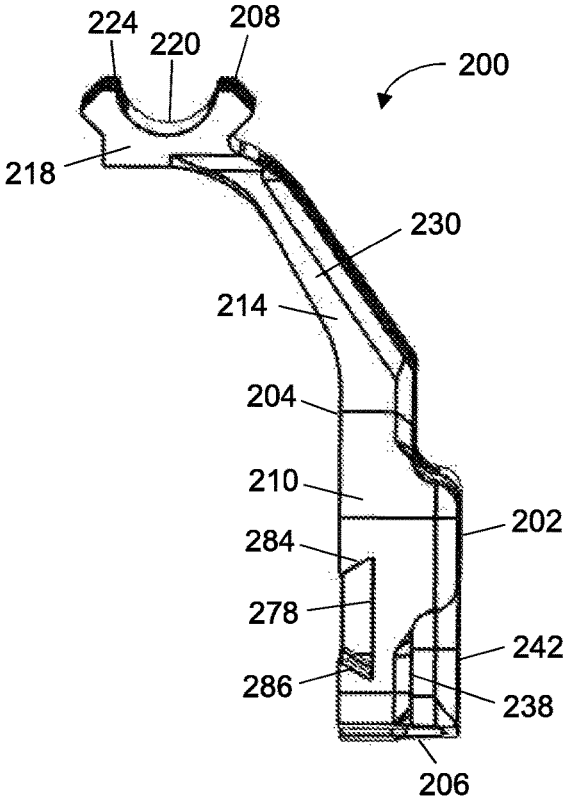
FIG. 16 is a side view of an exemplary optic mount.

The optic mount 200 includes a rail 218 (e.g., a Picattiny rail) at the top surface 208. The rail 218 includes a central groove 220 (e.g., a concave groove) extending the length of the top surface 208, with sets of slots 222 and steps 224 for mounting components to the rail 218. For example, an optical scope can be mounted to the rail 218. The central groove 220 provides clearance to use the rifle's fixed sights when the red dot or scope is removed from the rail 218 of the optic mount 200. As illustrated in FIG. 16, the front surface 208 can be angled rearward such that the rail 218 is disposed at an offset vertical plane relative to the bottom surface 206. When the optic mount 200 is secured to the receiver of a rifle, the rail 218 can be substantially aligned with the top and barrel of the rifle.

The optic mount 200 includes first and second cutouts 226, 228 formed in the body and extending between the front and rear surfaces 202, 204. In some embodiments, the cutout 226 can be substantially triangular in configuration and the cutout 228 can be substantially rectangular in configuration. The cutouts 226, 228 can reduce the overall weight of the optic mount 200 and can provide access to sections of the rifle when the optic mount 200 is secured to the receiver of the rifle. The cutouts 226, 228 result in three beams 230-234 of the body extending from the rail 218 downward towards a base section 236 of the optic mount 200. The beam 230 can define one lateral edge of the optic mount 200, the beam 232 can define an intermediate beam of the optic mount 200, and the beam 234 can define an opposing lateral edge of the optic mount 200. Although illustrated with beams 230-234, it should be understood that the optic mount 200 can include less than three beams 230-234 (e.g., a single cutout 226 with beams 230, 234), or can be completely solid between the opposing lateral edges (e.g., no cutouts 226, 228).

Figure 15:
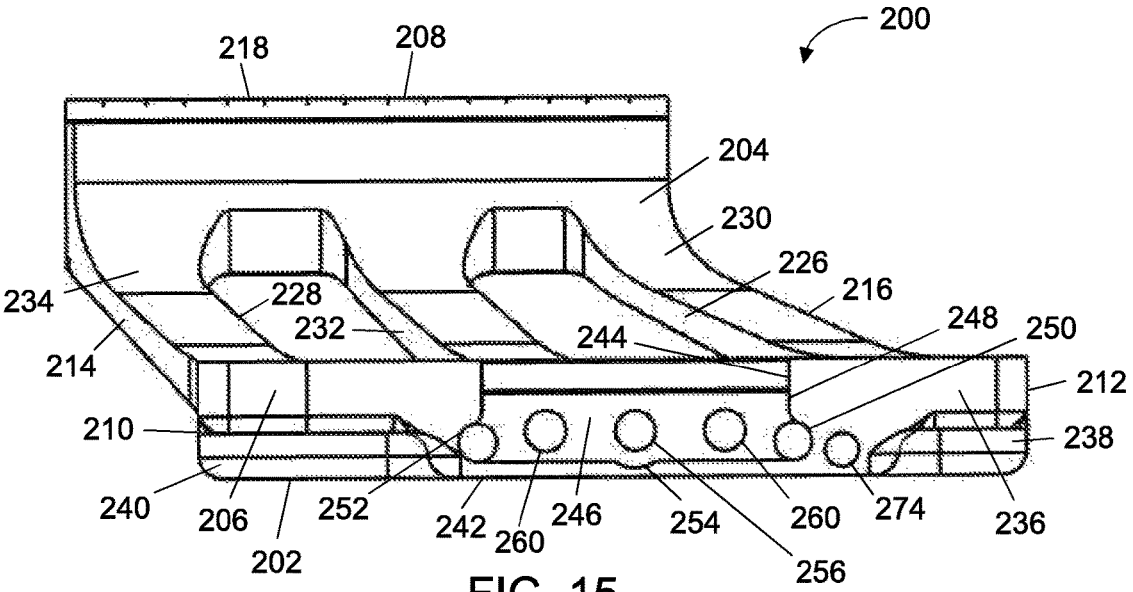
FIG. 15 is a bottom view of an exemplary optic mount.

The base section 236 of the optic mount 200 includes two recessed areas 238, 240 formed in the front surface 202 at or near the edge of the bottom surface 206. The recessed areas 238, 240 can be disposed on either side of a central section 242 of the front surface 202 protruding outwardly relative to the recessed areas 238, 240. At the rear surface 204, the base section 236 includes a cutout 244 extending from the bottom surface 206 upwards toward an inner step 246. As illustrated in FIG. 15, the cross-sectional configuration of the cutout 244 can be substantially complementary to the configuration of the clamping bar 102 (see, e.g., FIGS. 4 and 5). Particularly, the cutout 244 includes a substantially rectangular section 248 and semi-circular sections 250, 252 on opposing sides of the cutout 244. The width of the cutout 244 at the rear surface 204 corresponds with the width of the clamping bar 102 at the rear surface 112 such that the clamping bar 102 can slide upwards within the cutout 244 to engage an edge of the dovetail protrusion of a side rail. In some embodiments, the cutout 244 can include a concave groove 254 formed in the wall disposed between the semi-circular sections 250, 252. The groove 254 provides clearance for rotation of the fastener 106 during assembly.

A central hole 256 can be formed in the inner step 246 and extends through the body and through an outer step 258 at the front surface 202 of the optic mount 200. In embodiments including the spring 108 disposed around the fastener 106, the central hole 256 diameter can be dimensioned to accommodate passage of the spring 108 therethrough such that the spring 108 is disposed between surfaces of the clamping bar 102 and the lever 104. In some embodiments, the central hole 256 can be countersunk to accommodate the spring 108. Two holes 260 can be formed in the inner step 246 adjacent to the central hole 256, the holes 260 extending only a partial distance into the body without extending through to the outer step 258. When assembled with the clamping bar 102, the holes 260 can align with and correspond to holes 130, 132 in the clamping bar 102. One end of the springs 107, 109 can thereby be disposed within the holes 130, 132, and the opposing end of the springs 107, 109 can be disposed with the respective holes 260 to maintain the position and alignment of the springs 107, 109. The outer step 258 includes a vertical wall 262 extending substantially parallel to the front surface 202 and recessed relative to the front surface 202. The vertical wall 262 connects with a top wall 264 of the outer step 258, the top wall 264 defining the bottommost surface of the cutout 226.

A flange 266 extends from the vertical wall 262 at the top wall 264. The flange 266 can define a substantially thin thickness, resulting in a space 268 between the bottom surface of the flange 266 and the top surface of the outer step 258. The top surface of the flange 266 can be aligned with the top wall 264, and the frontmost surface of the flange 266 can be aligned with the central section 242 of the front surface 202. A hole 270 can be formed in the flange 266. The hole 270 defines a diameter dimensioned substantially similar to the diameter of the hole 256, and is aligned along a vertical axis with the hole 256. The base section 236 includes an oval cutout 272 in the vertical wall 262 disposed below the flange 266. The cutout 272 extends through the vertical wall 262 and to the rear surface 204. The base section 236 includes a threaded hole 274 formed in the outer step 258 at a position opposing the cutout 272. The threaded hole 274 can extend through the body and up to the bottom surface 206. As will be discussed in greater detail below, the threaded hole 274 can receive an engagement mechanism (see FIG. 17).

The rear surface 204 of the base section 236 includes a groove 278 formed therein and extending into the body towards the front surface 202. The groove 278 includes a first section 280 defining a substantially linear or rectangular configuration, and a second section 282 defining a substantially curved or circular configuration. The first section 280 can extend from the first opposing side section 212 towards the first opposing side section 210. The second section 282 can connect to the distal end of the first section 280 near the first opposing side section 210 without extending through to the first opposing side section 210. The internal configuration of the groove 278 at the first section 280 can be substantially dovetailed and is configured to slidably receive therein the dovetailed configuration of a side rail. The dovetailed configuration of the first section 280 forms angled sides 284, 286 expanding inwardly and tapering towards the rear surface 206 to reduce the opening of the groove 278 at the rear surface 204. The inner wall of the second section 282 can act as a stop to prevent further sliding of the optic mount 200 along the side rail in one direction. The cutout 244 formed in the optic mount 200 extends from the bottom surface 206 and at least partially into the first section 280 of the groove 278. As will be described below, the extension of the cutout 244 into the first section 280 allows for the clamping bar 102 to slide upwards through the cutout 244 to engage an edge of a dovetail protrusion of the side rail.

Figure 17:
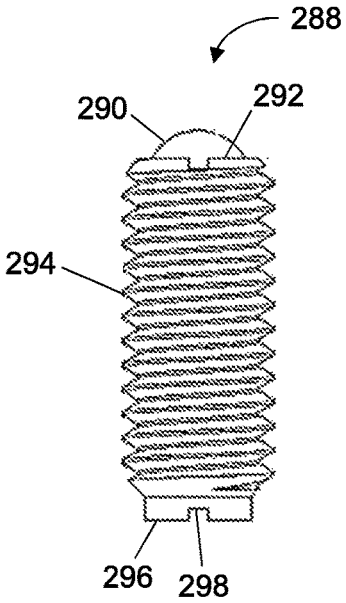
FIG. 17 is a side view of an engagement mechanism for an exemplary optic mount.

FIG. 17 is a side view of an engagement mechanism 288 for the optic mount 200. The engagement mechanism 288 can be in the form of a spring ball plunger. As will be discussed below, the engagement mechanism 288 can be used to temporarily lock the position of the lever 104 relative to the optic mount 200. The engagement mechanism 288 includes a spring-loaded ball 290 at one end, the ball 290 capable of being depressed into the body 292. The body 292 includes external threads 294 complementary to inner threads of the hole 274 in the optic mount 200. The base 296 of the engagement mechanism 288 includes a slot 298 for engagement with a screwdriver for installation of the engagement mechanism 288 within the hole 274 of the optic mount 200. For example, the engagement mechanism 288 can be inserted into and threaded through the hole 274 from the bottom surface 206 of the optic mount until the spring-loaded ball 290 extends the desired distance out of the hole 274 at the outer step 258. Although illustrated as extending from the outer step 258 to engage with a bottom surface of the lever 104, it should be understood that the engagement mechanism 288 could be placed laterally in the optic mount 200 (e.g., a lateral wall of the outer step 258) to secure the lever 104 from the side. In another embodiment, the lever 104 could be serviced from the top with the engagement mechanism 288 by reversing the fastener 106 orientation such that the fastener 106 head 178 is located above the lever 104 and threaded downward into the lever 104 and the optic mount 200.

Figure 18:
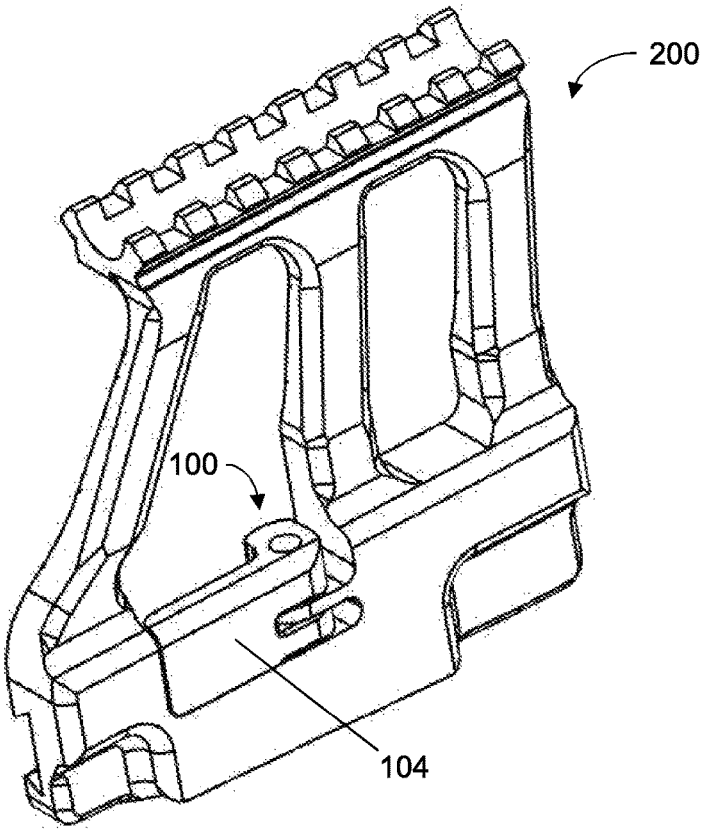
FIG. 18 is a perspective front view of an exemplary optic mount assembly coupled to an exemplary optic mount.
Figure 19:
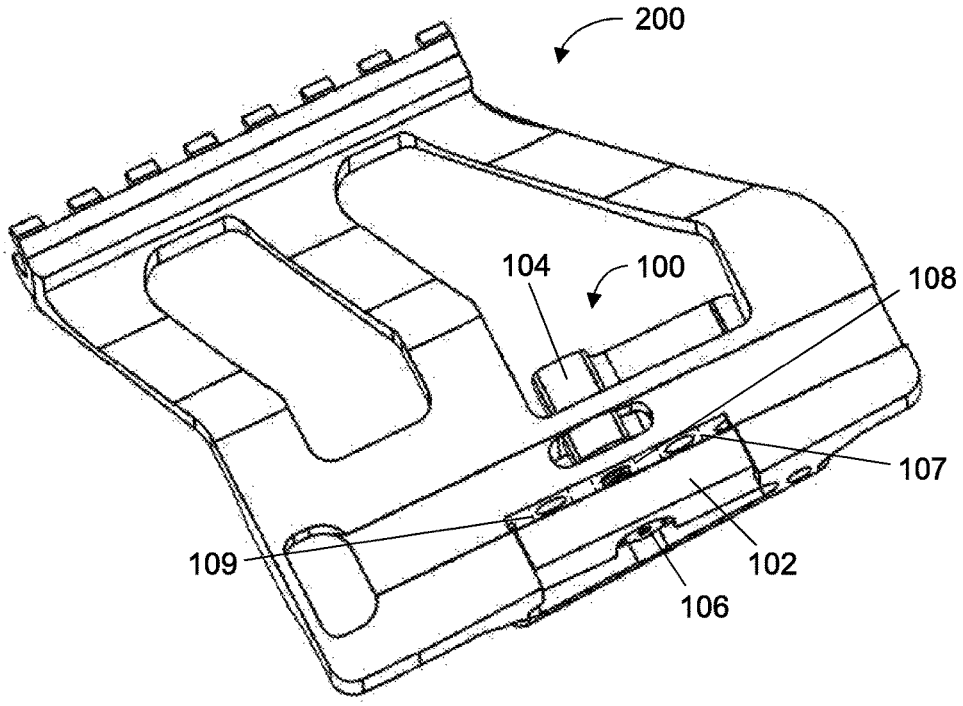
FIG. 19 is a perspective rear view of an exemplary optic mount assembly coupled to an exemplary optic mount.

FIGS. 18 and 19 show perspective front and rear views of the optic mount assembly 100 coupled to the optic mount 200 (e.g., an optic mount system). During assembly, the lever 104 can be fitted onto the optic mount 200 by sliding the flange 266 through the slot 164 of the lever 104. As the flange 266 slides into the slot 164, the top section 166 of the lever 104 fits over the top wall 264 of the optic mount 200 and the bottom section 168 of the lever 104 fits in the space 268 between the bottom surface of the flange 266 and the top surface of the outer step 258, and at least partially through the cutout 272. The outer surface 152 of the first section 146 of the lever 104 can substantially align with the front surface 202 of the optic mount 200. The first section 146 of the lever 104 fits against the vertical wall 262 and can be confined by the walls of the outer step 258.

The fastener 106 can be inserted through the hole 134 in the clamping bar 102 and the peaks 188 and valleys 190 at the head 178 of the fastener 106 can be engaged with respective slots 142 of the clamping bar 102. Such engagement maintains the rotational position of the fastener 106 relative to the clamping bar 102. In one embodiment, the spring 108 can be placed over the body 180 extending out of the hole 134 on the opposing side of the clamping bar 102 from the head 178. In another embodiment, one end of springs 107, 109 can be placed partially into the holes 130, 132 in the clamping bar 102 to provide a bilateral biasing force on either side of the fastener 106 between the clamping bar 102 and the optic mount 200. The opposing end of the springs 107, 109 can be placed partially into the holes 260 in the optic mount 200. The clamping bar 102 can be slid upwardly into the cutout 244 at the bottom surface 206 of the optic mount 200 until the distal end 192 of the fastener 106 passes through the central hole 256 in the optic mount 200 and threadingly engages with the holes 174, 176 of the lever 104.

Threading of the fastener 106 with the lever 104 adjusts the distance between the lever 104 and the clamping bar 102 based on the size of the side rail. Engagement between the fastener 106 and the lever 104 also maintains the assembly 100 coupled to the optic mount 200. If adjustment of the distance between the lever 104 and the clamping bar 102 is needed, the head 178 of the fastener 106 can be disengaged from the slots 142 of the clamping bar 102, the fastener 106 can be rotated to reduce or increase the distance between the lever 104 and the clamping bar 102, and the head 178 can be engaged with the slots 142. For example, the clamping bar 102 can be pushed upwards within the cutout 244 to be positioned against the protrusion 320 of the side rail 300, and the fastener 106 can be threaded into the holes 174, 176 until the fastener 106 can be engaged again with the slots 142 to maintain the rotation position of the fastener 106. When the desired position of the fastener 106 is achieved, the lever 104 can be rotated to tighten the clamping bar 102 relative to the side rail.

Rotation of the lever 104 can tighten or loosen the connection between the fastener 106 and the lever 104, thereby adjusting the distance between the top surface 122 of the clamping bar 102 and the inner step 246 (see, e.g., FIG. 19). Because the cutout 244 extends at least partially into the first section 280 of the groove 278 in the optic mount 200, reducing the distance between the clamping bar 102 and the inner step 246 results in movement of the clamping bar 102 into the groove 278. As will be discussed below, during engagement of the optic mount 200 with a dovetail protrusion of the side rail, reduction of the distance between the clamping bar 102 and the inner step 246 results in the clamping bar 102 imparting a force on the side rail to maintain the position of the optic mount 200 relative to the side rail.

Depending on the dimensions of the side rail dovetail protrusion, the radial position of the head 178 of the fastener 106 can be incrementally adjusted relative to the slots 142 of the clamping bar 102 to provide for a tighter or looser customized distance between the clamping bar 102 and the inner step 246. FIG. 18 shows the lever 104 in the closed or locked position. Prior to locking the lever 104, the first section 146 of the lever 104 can be pivoted outward to project away from the optic mount 200 (e.g., by about 90°, by between about 45° and about 110°, or the like). The desired distance between the clamping bar 102 and the inner step 246 (and/or the bottom edge of a dovetail protrusion of a side rail) can be achieved, and the lever 104 can be pivoted or rotated inwardly to the position shown in FIG. 18 to lock the lever 104 in place. The engagement mechanism 288 projecting from the optic mount 200 can engage with the detent 160 in the lever 104 to maintain the rotational position of the lever 104 relative to the optic mount 200 until unlocking of the lever 104 is desired. Upon unlocking of the lever 104 and rotation outwardly, the spring 108, 107, 109) between the clamping bar 102 and the optic mount 200 and/or the lever 104 can act as a quick release mechanism to bias the clamping bar 102 away from the optic mount 200 and/or the lever 104, to release the side rail.

Figure 20:
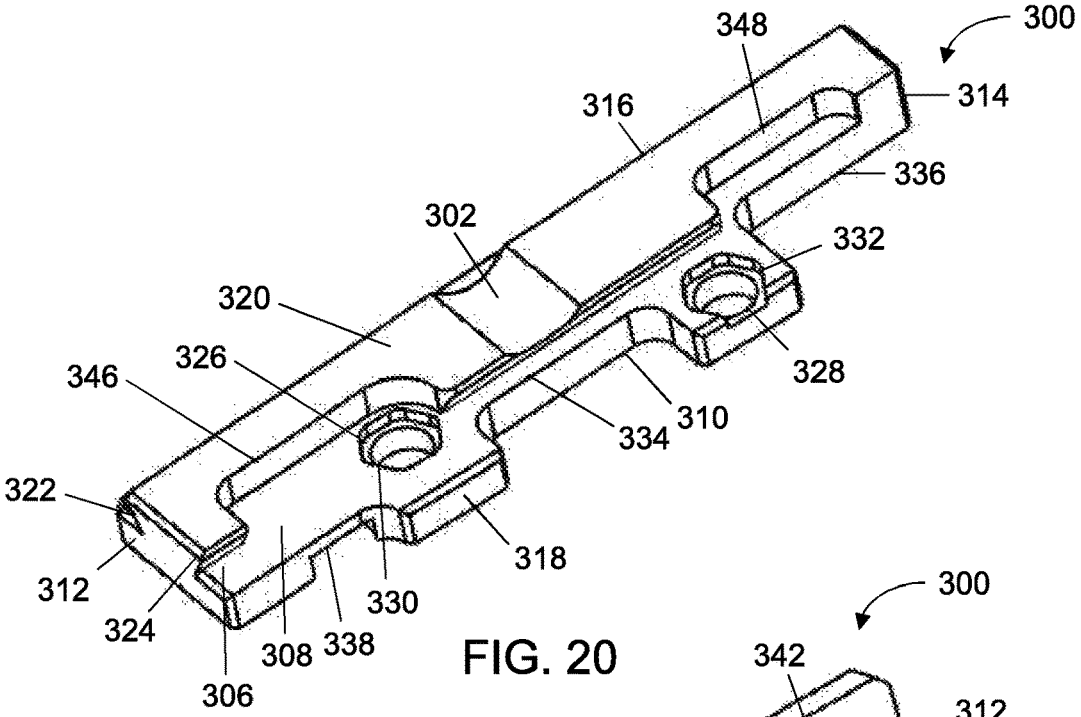
FIG. 20 is a front perspective view of an exemplary fixation point in the form of a side rail.
Figure 21:
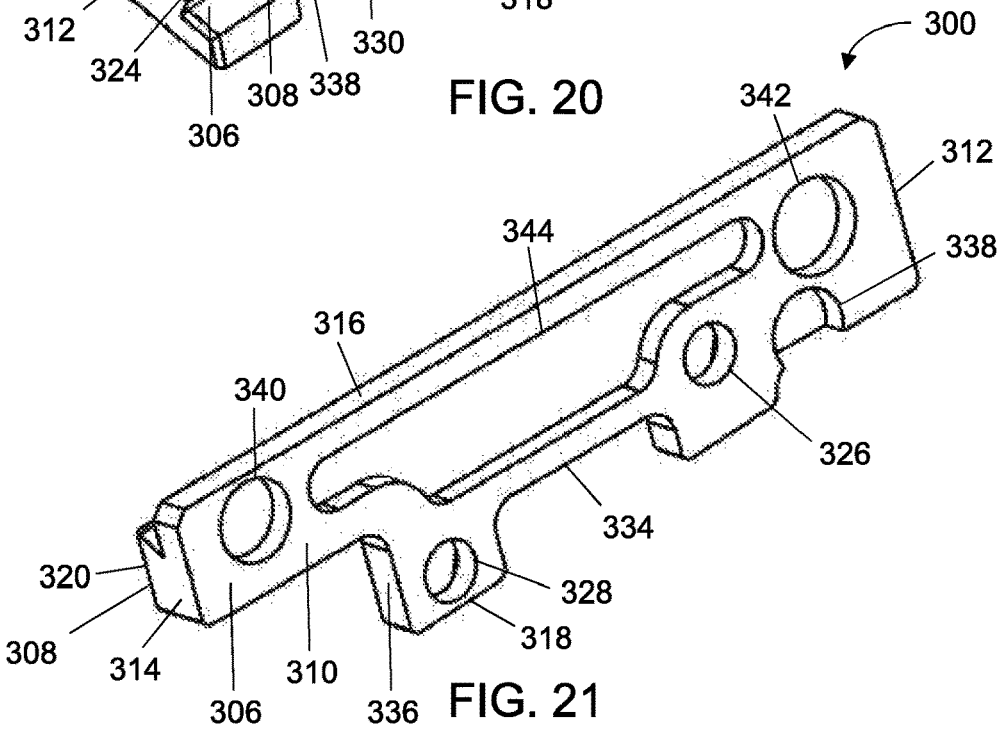
FIG. 21 is a rear perspective view of an exemplary fixation point in the form of a side rail.
Figure 22:
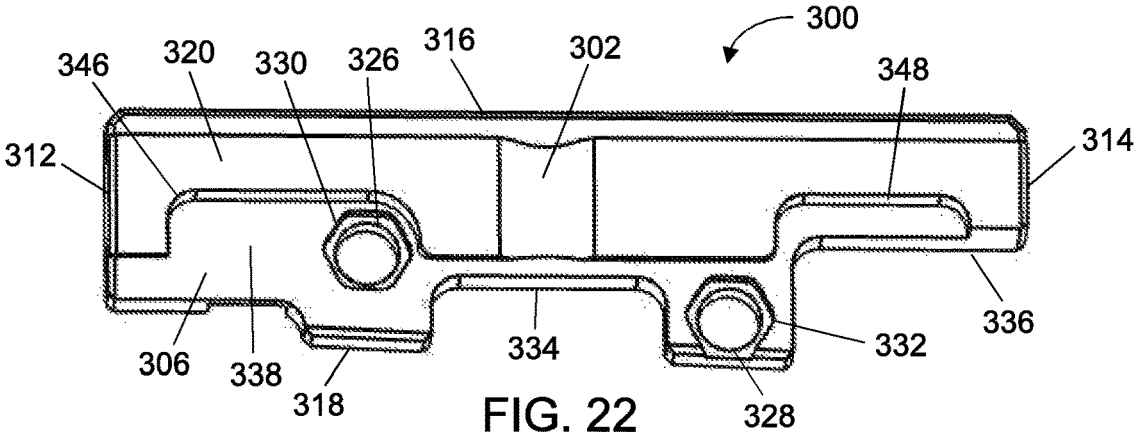
FIG. 22 is a front view of an exemplary fixation point in the form of a side rail.

FIGS. 20-22 are front perspective, rear perspective and front views of an exemplary fixation point 300 in the form of a side rail. The fixation point 300 is configured to be detachably mounted to a receiver of a rifle with the mounting pins (not shown), and can be used to attach various components (e.g., the optic mount 200, or the like) to the side of the rifle. The fixation point 300 includes a substantially rectangular body 306 having a front surface 308, a rear surface 310, side edges 312, 314, top edge 316, and bottom edge 318. The front and rear surfaces 308, 310 can be substantially planar or flat. The side, top and bottom edges 312-318 can be substantially planar or flat and, in some embodiments, can be connected by chamfered edges. As shown in FIG. 20, the fixation point 300 includes a protrusion 320 having a dovetail configuration. The protrusion 320 extends away from the front surface 308 with side edges 322, 324 of the protrusion 320 expanding outwardly at angles greater than 90°. The section of the protrusion 320 connected at the front surface 308 is therefore dimensioned smaller in width than the outermost section of the protrusion 320. As noted above, the optic mount 200 (or another component) includes a complementary dovetail groove 278 configured to slidably receive the protrusion 320 to mount the optic mount 200 to the fixation point 300. The protrusion 320 extends between and up to the side surfaces 312, 314 defining a substantially planar uppermost surface therebetween.

The fixation point 300 includes two spaced openings 326, 328 extending between the front and rear surfaces 308, 310. The openings 326, 328 can be countersunk holes with recesses 330, 332 surrounding the openings 326, 328 at the front surface 308. When positioned against the receiver of a rifle, the openings 326, 328 can align with corresponding openings in the receiver wall such that mounting pins can be passed through the openings 326, 328 and the receiver wall to secure the fixation point 300 to the rifle.

The fixation point 300 includes a concave, scalloped section 302 (e.g., a cutout) formed in the protrusion 320. In some embodiments, the scalloped section 302 can be disposed at a midpoint or central location of the protrusion 320 as measured between the side surfaces 312, 314. The scalloped section 302 can extend from the uppermost surface of the protrusion 320 downwardly towards the top surface 308 of the fixation point 300. The scalloped section 302 is configured to receive at least a portion of a contoured top and/or bottom section 166, 168 of the lever 104 to prevent lateral movement of the optic mount 200 relative to the fixation point 300.

The fixation point 300 can include one or more cutouts for accommodating components of the rifle and/or reducing the overall weight of the fixation point 300. For example, the fixation point 300 can include cutouts 334, 344 for reducing the overall weight of the fixation point 300. The fixation point 300 can also include cutouts 336, 338 and recessed areas 340, 342. Cutout 336 provides clearance for a folding triangle stock frequently used on an AK rifle, recessed areas 340, 342 provide clearance for rivet heads on the AK rifle's receiver wall, and cutout 338 provides clearance for an AK rifle's auto sear axis pin. The cutout 334 can be substantially rectangular in shape and disposed between the holes 326, 328. In some embodiments, the fixation point 300 can include cutouts 346, 348 formed in the protrusion 220 for reducing the overall weight of the fixation point 300. The cutouts 346, 348 can be disposed on opposing sides of the cutout 334 and spaced from the side surfaces 312, 314, thereby maintaining a wide section of the protrusion 320 for mounting of a rifle component to the fixation point 300.

Figure 23:
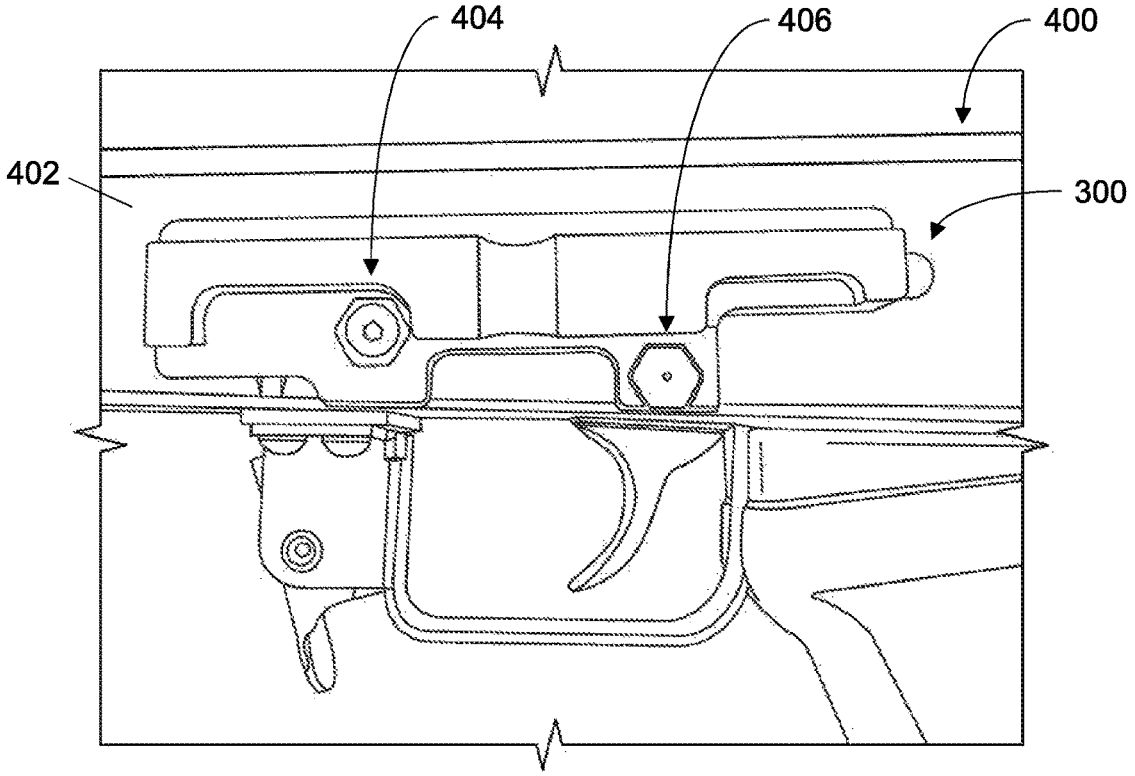
FIG. 23 is a front view of an exemplary fixation point mounted to a left receiver wall of a rifle.
Figure 24:
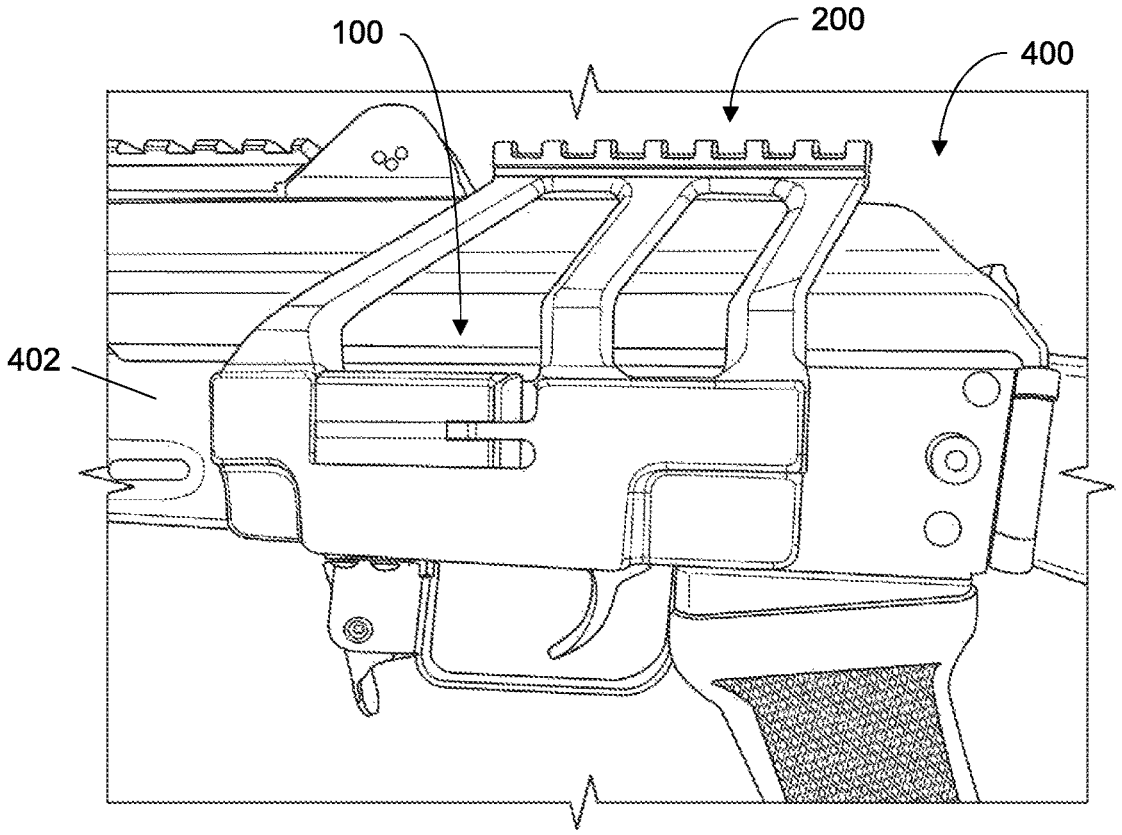
FIG. 24 is a side view of an exemplary optic mount and optic mount assembly coupled to a fixation point mounted to a receiver wall of a rifle.

FIG. 23 is a front view of the fixation point 300 mounted to a left wall of a receiver 402 of a rifle 400, and FIG. 24 is a side view of the optic mount 200 mounted to the fixation point 300 with the optic mount assembly 100. The fixation point 300 can be positioned against the outer surface of the receiver 402 and mounting pins 404, 406 can be used to secure the fixation point 300 to the receiver 402. The optic mount 200 can be engaged with the fixation point 300 by sliding the protrusion 320 of the fixation point 300 into the groove 278 of the optic mount 200. The optic mount assembly 100 can be assembled with the optic mount 200 as described above with respect to FIGS. 18 and 19. Particularly, the lever 104 can be positioned over and adjacent to the flange 266, and the clamping bar 102 can be assembled with the fastener 106.

The clamping bar 102 can be slid upwardly into the cutout 244 at the bottom surface 206 of the optic mount 200 until the distal end 192 of the fastener 106 passes through the central hole 256 in the optic mount 200 and threadingly engages with the holes 174, 176 at the bottom of the lever 104. As the clamping bar 102 is slid upwardly into the cutout 244, the cutout 128 in the clamping bar 102 is positioned against an edge of the protrusion 320 due to the extension of the cutout 244 into the first section 280 in the optic mount 200. The fastener 106 can be tightened relative to the lever 104 to reduce the distance between the cutout 128 and the protrusion 320.

The lever 104 can be rotated into the locked or closed position shown in FIG. 24 to further engage the fastener 106 and reduce the distance between the clamping bar 102 and the protrusion 320. Rotation of the lever 104 into the locked or closed position compresses the cutout 128 of the clamping bar 102 against the edge of the protrusion 320. The compression force between the cutout 128 and the protrusion 320 prevents both vertical (up and down) and lateral movement of the optic mount assembly (and, in turn, the optic mount 200) relative to the fixation point 300. As the lever 104 is rotated into the locked or closed position, the top and/or bottom sections 166, 168 of the lever 104 rotate into and engage with the scalloped section 302 of the fixation point 300. The engagement between the lever 104 and the cutout (e.g., scalloped section 302) prevents lateral movement of the optic mount assembly 100 (and, in turn, the optic mount 200) relative to the fixation point 300 (e.g., prevents sliding of the optic mount 200 along the protrusion 320). In addition to the engagement mechanism 288, engagement between the lever 104 and the scalloped section 302 can assist in maintaining the locked position of the lever 104. The optic mount assembly 100 thereby prevents both lateral and vertical movement of the optic mount 200 relative to the fixation point 300, and can conform to protrusions 320 of different sizes.

While exemplary embodiments have been described herein, it is expressly noted that these embodiments should not be construed as limiting, but rather that additions and modifications to what is expressly described herein also are included within the scope of the present disclosure. Moreover, it is to be understood that the features of the various embodiments described herein are not mutually exclusive and can exist in various combinations and permutations, even if such combinations or permutations are not made express herein, without departing from the spirit and scope of the present disclosure.

The invention claimed is:

1. An optic mount assembly, comprising:

a clamping bar including a body and protrusions extending from opposing side surfaces of the body;

a lever pivotally coupled to the clamping bar, the lever including (i) a top section and a bottom section, (ii) a slot extending between and separating the top section from the bottom section, and (iii) a hole with internal threads, the hole including a first hole extending through the top section and a second hole extending through the bottom section, the first and second holes aligned along a vertical axis; and a fastener including external threads complementary to the internal threads of the hole of the lever, wherein engagement of the external threads of the fastener with the internal threads of the hole of the lever, and rotation of the lever relative to the clamping bar couples the lever to the clamping bar.

2. The optic mount assembly of claim 1, wherein the lever is configured to be rotated into and engaged with a cutout of a side rail, and configured to be inserted into a cutout in an optic mount.

3. The optic mount assembly of claim 1, wherein the clamping bar includes front and rear surfaces on opposing sides of the body, the protrusions extending from the opposing side surfaces and aligned with the front surface of the clamping bar.

4. The optic mount assembly of claim 1, wherein the clamping bar includes a first recessed area formed in a bottom surface and extending a partial distance towards a top surface of the clamping bar, the first recessed area aligned with a front surface of the clamping bar.

5. The optic mount assembly of claim 4, wherein the clamping bar includes a second recessed area disposed within the first recessed area, the second recessed area including a plurality of radially spaced vertical slots configured to engage with a head of the fastener.

6. The optic mount assembly of claim 5, wherein the clamping bar includes a hole extending through the body, the first and second recessed areas concentrically disposed relative to the hole.

7. The optic mount assembly of claim 1, wherein the lever includes a first section extending substantially perpendicularly from a second section, the first and second section defining a substantially L-shaped configuration.

8. The optic mount assembly of claim 7, wherein the second section includes the slot extending therethrough, the slot separating the second section into the top section and the bottom section.

9. The optic mount assembly of claim 1, wherein the fastener includes a head with a plurality of radially spaced peaks and valleys configured to engage with complementary slots formed in the clamping bar.

10. The optic mount assembly of claim 1, comprising one or more springs disposed between the clamping bar and the lever, or between the clamping bar and an optic mount.

11. An optic mount system, comprising:

an optic mount; and an optic mount assembly coupled to the optic mount, the optic mount assembly including:

a clamping bar including a body and protrusions extending from opposing side surfaces of the body;

a lever pivotally coupled to the clamping bar, the lever including (i) a top section and a bottom section, (ii) a slot extending between and separating the top section from the bottom section, and (iii) a hole with internal threads, the hole including a first hole extending through the top section and a second hole extending through the bottom section, the first and second holes aligned along a vertical axis; and a fastener including external threads complementary to the internal threads of the hole of the lever, wherein engagement of the external threads of the fastener with the internal threads of the hole of the lever, and rotation of the lever relative to the clamping bar couples the lever to the clamping bar.

12. The optic mount system of claim 11, wherein the optic mount includes a cutout formed in a bottom surface and extending inwardly into a body of the optic mount.

13. The optic mount system of claim 12, wherein the cutout is complementary to the body and the protrusions of the clamping bar, the cutout configured to slidingly receive therein the clamping bar.

14. The optic mount system of claim 11, wherein the optic mount includes a central section with an outer step.

15. The optic mount system of claim 14, wherein the lever is configured to fit within the outer step of the optic mount.

16. The optic mount system of claim 14, wherein the optic mount includes a flange extending outwardly from a wall of the outer step.

17. The optic mount system of claim 16, wherein the lever includes a first section extending substantially perpendicularly from a second section, the slot extending through the second section and separating the second section into the top section and the bottom section.

18. The optic mount system of claim 17, wherein the flange of the optic mount is configured to fit within the slot of the second section of the lever.

19. An optic mount assembly, comprising:

a clamping bar including a body with front and rear surfaces on opposing sides of the body, the clamping bar including protrusions extending from opposing side surfaces of the body;

a lever pivotally coupled to the clamping bar, the lever including a first section extending substantially perpendicularly from a second section, the second section including (i) a top section and a bottom section, (ii) a slot extending between and separating the top section from the bottom section, and (iii) a hole with internal threads, the hole including a first hole extending through the top section and a second hole extending through the bottom section, the first and second holes aligned along a vertical axis; and a fastener including external threads complementary to the internal threads of the hole of the lever, wherein engagement of the external threads of the fastener with the internal threads of the hole of the lever, and rotation of the lever relative to the clamping bar couples the lever to the clamping bar.

* * * * *